United States Patent [19]

Hay

[11] Patent Number: 4,781,138

[45] Date of Patent: Nov. 1, 1988

[54] STANDOFF MOORING BAR FOR BOATS

[76] Inventor: Duff M. Hay, 1509 Lake Holiday Dr., Sandwich, Ill. 60548

[21] Appl. No.: 75,431

[22] Filed: Jul. 20, 1987

[51] Int. Cl.[4] ..... B63B 17/00; B63B 21/00

[52] U.S. Cl. ..... 114/221 R; 114/230; 403/109

[58] Field of Search ..... 114/230, 221 R, 219, 114/250; 403/109, 377

[56] References Cited

U.S. PATENT DOCUMENTS

| | | | |
|---|---|---|---|
| 2,685,460 | 8/1954 | Ogborn et al. | 403/109 X |
| 3,224,404 | 12/1965 | De Jong | 114/230 |
| 3,235,296 | 2/1966 | Day | 403/109 X |
| 3,406,651 | 10/1968 | Jalbert | 114/230 |
| 3,863,591 | 2/1975 | Wild | 114/230 |

*Primary Examiner*—Sherman D. Basinger

*Attorney, Agent, or Firm*—Augustus G. Douvas

[57] ABSTRACT

A standoff mooring bar for a boat featuring an adjustable mooring bar body. This body has an inner cylindrical tube telescoping within an outer cylindrical tube, and a pair of end caps closing the telescoping pair of tubes. A mooring rope extends through the pair of tubes through openings located in both end caps. A compression locking assembly fixes the adjustable length of the telescoping pair of tubes. The locking assembly includes a generally cylindrical threaded sleeve fixed to the outer tube opposite its capped end, a thraded locking cap through which the inner tube passes, and a compression ring seal seated upon the inner tube and captured between the sleeve and the locking cap. The locking cap is manually tightened relative the threaded sleeve to cause the ring seal to bind frictionally the two telescoping tubes to a fixed length. A guy rope is fixed to the sleeve in such a manner that the guying forces do not tend to alter the combined length of the two telescoped tubes.

11 Claims, 2 Drawing Sheets

STANDOFF MOORING BAR FOR BOATS

This invention relates to a telescoping bar for boats which can be adjusted to moor a boat at various distances from a dock and which also can be used with different boat cleat configurations.

BACKGROUND OF THE INVENTION

It is commonplace to moor a boat to a dock or to another boat. Severe weather conditions, such as rough water or turbulent winds, can buffet the boat excessively causing damage, or even loss of the boat.

The prior art relating to devices for mooring a boat is extensive. This art includes bumpers or fenders which may be attached either to the boat or to a dock to prevent the boat from being damaged by hitting against the dock due to the action of wind and waves. However, these bumpers rub and scuff the boat often causing moderate but permanent damage to the boat.

Accordingly, mooring devices were developed which separate the boat from the structure to which it is moored. Most of these devices employ a rigid elongated body which is used as a separating bar to cause a boat to standoff from its dock. U.S. Pat. Nos. 2,938,492, 3,224,404, 3,863,591, and 3,878,808 disclose typical structures having bars of constant length. U.S. Pat. Nos. 2,558,174 and 3,406,651 disclose mooring of several, discrete varying lengths produced by telescoping one element within another. However, these telescoping bars are not infinitely adjustable within the minimum and maximum lengths. Additionally, they are cumbersome to apply in certain docking situations because the length of the rope guy varies with the length of the mooring bar.

SUMMARY OF THE INVENTION

Accordingly, a principal object of this invention is to provide a simple mooring bar, which is easy to apply, which can be manually adjusted to any length between its minimum and maximum limits of length, and which can be used with different boat cleat configurations.

A preferred embodiment of the standoff mooring bar of this invention features an inner cylindrical plastic tube telescoping within an outer cylindrical plastic tube. Both ends of the telescoping pair of tubes are closed by plastic end caps. A single length of mooring rope passes through the composite bore defined by both tubes with a tie end emerging from a hole located in each end cap.

A plastic compression locking assembly comprising a threaded cylindrical sleeve is glued to and projects beyond the outer tube to mate with a threaded locking cap seated over the inner tube. A rubber compression ring envelops the inner tube and is located in a cavity of varying size formed by the composite inner recesses of the sleeve and the locking cap.

In selecting a desired operating length for the mooring bar of this invention, the inner and outer tubes are telescoped to the appropriate length and the locking cap is tightened until the compression ring binds the two tubes together by friction to a fixed length.

A guy rope, which prevents swaying of a boat to which a pair of mooring bars are attached, is secured to the threaded sleeve which is seated upon the outer tube. Since the guy rope is always a fixed distance from the end of the outer tube of the mooring bar, the length of guy rope required for a given boat and dock will not vary regardless of different standoff mooring distances.

Additionally, the particular mode of guy rope attachment to the sleeve is so isolated from the compression lock that the guying forces do not tend to break the lock, and thus alter the length of the mooring bar.

DESCRIPTION OF THE DRAWINGS

In order that all of the structural features for attaining the objects of this invention may be readily understood, reference is made to the accompanying drawings in which.

DETAILED DESCRIPTION OF THE PREFERRED EMBODIMENT

Figure 1:
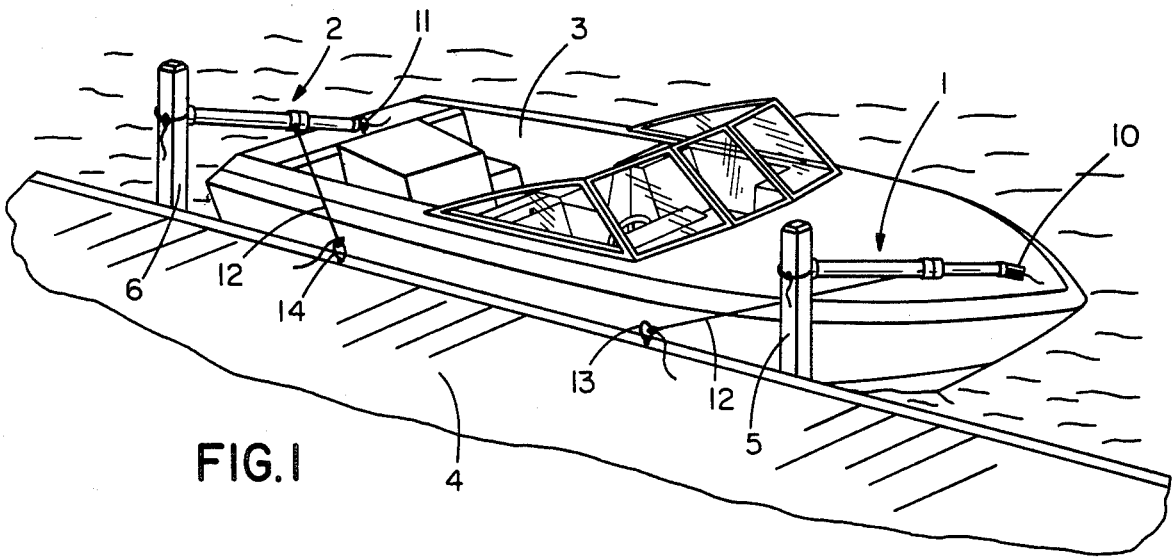
FIG. 1 is a perspective view showing the application to a boat of a pair of the standoff mooring bars of this invention.
Figure 2:
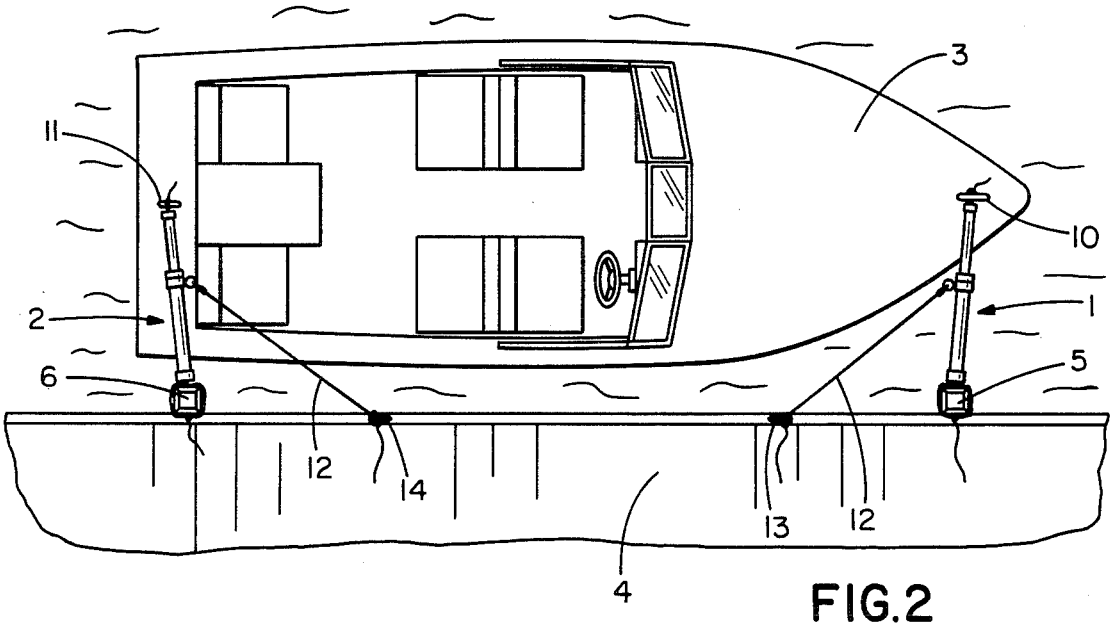
FIG. 2 is a plan view of the structure of FIG. 1.
Figure 3:
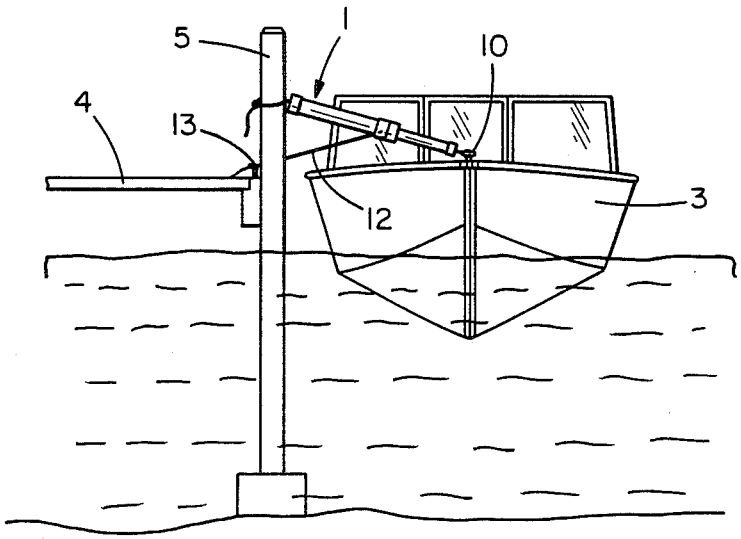
FIG. 3 is a bow end view of the structure of FIGS. 1 and 2.

FIGS. 1–3 of the drawings show a typical application of a pair of standoff mooring bars 1 and 2 of this invention in securing boat 3 to a dock 4 and a pair of docking posts 5 and 6.

Each mooring bar 1 and 2 is adjustable in length to provide a standoff distance which moors boat 3 out of contact with dock 4 to avoid damaging the hull of the boat.

Figure 4:
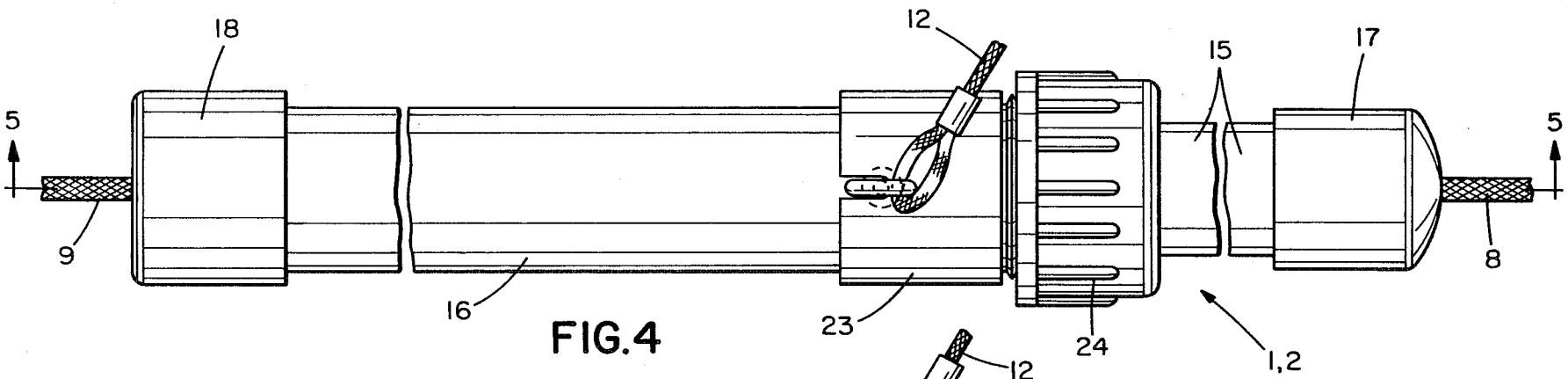
FIG. 4 is an external view of a single standoff mooring bar of this invention.
Figure 5:
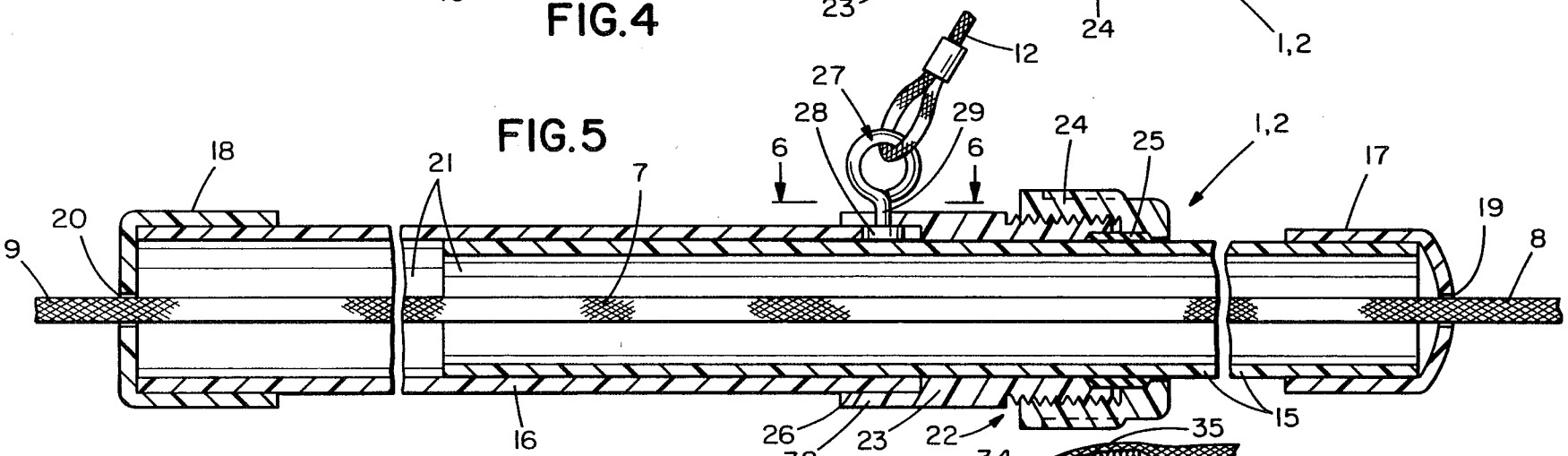
FIG. 5 is a section view taken along line 5—5 of FIG. 4.

As is best shown in FIGS. 4 and 5, a mooring rope 7 passes through the central bore of each mooring bar so that rope tie ends 8 and 9 project out of the device. Tie ends 8 of each bar 1 and 2 are secured to boat cleats 10 and 11, and tie ends 9 are secured to docking posts 5 and 6.

A first guy rope 12 extends between mooring bar 1 and docking ring 13, and a second guy rope 12 extends between mooring bar 2 and docking ring 14. This arrangement of guy ropes and mooring bars establishes a pair of triangles which prevents boat 3 from swaying relative dock 4.

Figure 6:
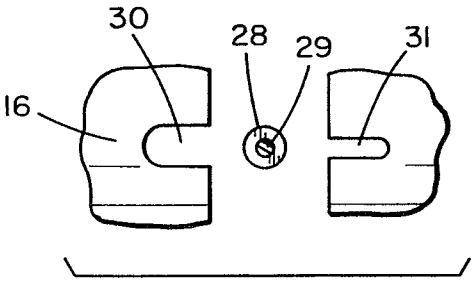
FIG. 6 is a fragmentary exploded view taken along line 6—6 of FIG. 5 which shows the locking attachment for the guy anchor eyebolt.

Mooring bars 1 and 2 have an identical construction which is shown in detail in FIGS. 4–6. Each bar has a body which has a manually adjustable length. The body is formed by telescoping an inner cylindrical plastic tube 15 within outer tube 16. The exposed end of inner tube 15 is permanently closed by plastic end cap 17, and the opposite exposed end of outer tube 16 is permanently closed by plastic end cap 18. Tubes 15 and 16, and end caps 17 and 18, may be fabricated from polyvinyl chloride, and the end caps glued to their associated tubes. In certain boat mooring situations it may be advisable to use two or more mooring bars having outer tubes 16 of different lengths.

Each end cap 8 and 9 is formed with a central hole 19 or 20. Mooring rope 7 passes through holes 19 and 20, and cavity 21 formed by the composite bores of tubes 15 and 16.

The length of each mooring bar 1 and 2 is adjusted as desired by manually varying the extent of telescoping insertion of inner tube 15 within outer tube 16. The selected length is maintained by a compression locking assembly 22, comprising a threaded plastic sleeve 23, a threaded plastic locking cap 24 which mates with sleeve 23, and a rubber compression ring 25 seated in a composite cavity formed by mated elements 23-24 seated on inner tube 15. Sleeve 23 is permanently fixed to outer tube 16 by gluing all contacting surfaces between these two elements. In particular, the left inner bore of sleeve 23 (FIG. 6) is formed with an annular recess 26 which serves as a socket for the right end of outer tube 16. The mating surfaces within this socket are fixed by gluing. Accordingly, as locking cap 24 is threaded on sleeve 23, ring 25 is compressed within the reduced cavity formed by mated elements 23 and 24 until locking assembly 22 binds by friction inner tube 15 into a fixed position relative outer tube 16.

Guy rope 12 is secured to mooring bar 1, 2 by metallic anchor eyebolt 27 (FIGS. 5 and 6). A circular retaining disc 28 is fixed to the end of eyebolt shank 29. Disc 28 is seated within U-shaped socket slot 30 (FIG. 6) formed on the right end of outer tube 16. A smaller U-shaped locking slot 31 is formed on the left end of sleeve 23 overlying slot 30. Slot 31 engage tightly shank 29 of eyebolt 27. Thus, eyebolt 27 is locked to mooring bars 1, 2 by slots 30 and 31. It is noted that eyebolt 27 is the only metal element employed in the structure of FIGS. 1–6; the remaining elements are plastic.

Figure 7:
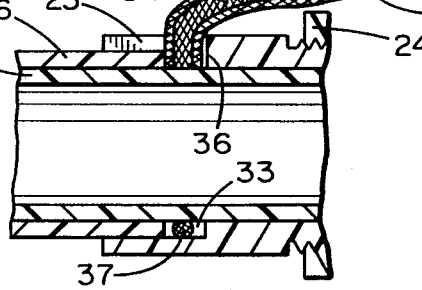
FIG. 7 is a fragmentary view which shows a modified attachment of the guy rope to the mooring bar.

If an all plastic mooring bar is desired, the alternative guy rope attachment of FIG. 7 may be employed. In this modification, braided plastic rope 12 has a ring loop 37 lodged within annular cavity 33 which envelops inner tube 15. The overlapping and contacting surfaces of outer tube 16 and sleeve 23 are glued together so as to leave the space required to define annular cavity 33. Ring loop 37 may be easily formed by inserting one end 34 of braided rope between the interstices and into the bore of the braid so that exterior braid section 35 tension locks upon the inserted braid portion 34. (This lock is sometimes called a "Chinese" lock.) Sleeve 23 is formed with a hole 36 through which guy rope 12 projects.

A most important feature of the guying attachment of ring loop 37 is that the guying force enhances the friction between inner and outer tubes 15 and 16. This enhanced friction enables these tubes to maintain reliably their composite telescoped fixed length by further assuring that the compression lock is not broken.

Guy rope 12 can be secured to mooring bars 1, 2 by other arrangements which do not require an anchor eyebolt, or a rope looped around inner tube 15, as is shown in FIG. 7. For example, an enlarged end (not shown) on guy rope 12 can be captured within a recess, such as recess 26. Rope 12 is fixed to mooring bars 1, 2 by passing the rope through a small hole (not shown) located in the projecting shoulder of sleeve 23.

Regardless of the particular guy rope attachment used, it is an important feature of this invention, that the guying force exerted by rope 12 is isolated from the compression lock in such a way that it does not tend to break the compression lock. This makes possible a compression lock design, with its infinite range of adjustments between the minimum and maximum lengths available by telescoping tubes 15 and 16.

The preferred embodiment previously described is illustrative of the principles of this invention. It should be understood, modifications can be made without departing from the scope of the invention.

What is claimed is:

1. A standoff mooring bar for a boat comprising an adjustable mooring bar body having an elongated inner cylindrical tube telescoping within an elongated outer cylindrical tube; a mooring rope extending through the bore of the telescoping pair of cylindrical tubes; and a compression locking assembly fixing the adjustable length of the telescoping pair of tubes with the locking assembly including a generally cylindrical locking sleeve fixed to the outer tube adjacent its tube and which receives the inner tube, a locking cap through which the inner tube passes and which is formed to mate adjustably with the locking sleeve, and a compression ring seal enveloping the inner tube and captured between the locking sleeve and the locking cap which upon tightening of the locking cap relative the sleeve causes the ring seal to bind frictionally and thus lock the two telescoping tubes to a fixed length which is infinitely variable between the minimum and maximum telescoping lengths; and means for attaching a guy rope to the mooring bar.

2. A standoff mooring bar for a boat comprising an adjustable mooring bar body having an elongated inner cylindrical tube telescoping within an elongated outer cylindrical tube; a mooring rope extending through the bore of the telescoping pair of cylindrical tubes; and a compression locking assembly fixing the adjustable length of the telescoping pair of tubes with the locking assembly including a generally cylindrical locking sleeve fixed to the outer tube adjacent its tube end which receives the inner tube, a locking cap through which the inner tube passes and which is formed to mate adjustably with the locking sleeve, a compression ring seal enveloping the inner tube and captured between the locking sleeve and the locking cap which upon tightening of the locking cap relative the sleeve causes the ring seal to bind frictionally and thus lock the two telescoping tubes to a fixed length, and a guy rope coupled to the mooring bar between the outer tube and the compression ring thereby isolating the lock from the guying force exerted by the guying rope.

3. The combination of claim 2 comprising a pair of apertured end caps closing the opposite ends of the telescoping pair of tubes, and the mooring rope passing through the apertures of the end caps.

4. The combination of claim 3 in which the guy rope is formed with a ring loop which envelops the inner tube, thereby enhancing the frictional force which locks the two telescoping tubes to a fixed length.

5. The combination of claim 4 in which the ring loop is lodged in an annular cavity defined by the locking sleeve and the outer tube.

6. The combination of claim 3 comprising an anchor eyebolt attached to the guy rope and in which the eyebolt is locked by the outer tube and the locking sleeve.

7. A standoff mooring bar for attachment to a boat comprising an adjustable mooring bar body having an inner cylindrical tube telescoping within an outer cylindrical tube; a pair of end caps closing the telescoping pair of tubes; a mooring rope extending through the telescoping pair of tubes and through openings located in both end caps; and a compression locking assembly fixing the adjustable length of the telescoping pair of tubes with the locking assembly including a generally cylindrical threaded sleeve fixed to the outer tube opposite its capped end a locking cap seated upon the inner tube and threaded to mate adjustably with a locking sleeve, and a compression ring seal seated upon the inner tube and captured between the sleeve and the locking cap which upon tightening of the locking cap relative the threaded sleeve causes the ring seal to bind frictionally the two telescoping tubes to a fixed length, and means for attaching a guy rope to the mooring bar at a locus remote from the length of the mooring bar located between the compression ring seal and the mooring bar attachment to the boat so that the ring seal is relieved of the excessive force of guying which would otherwise tend to break the seal.

8. A standoff mooring bar for a boat comprising an adjustable mooring bar body having an inner cylindrical tube telescoping within an outer cylindrical tube; a pair of end caps closing the telescoping pair of tubes; a mooring rope extending through the telescoping pair of tubes and through openings located in both end caps; and a compression locking assembly fixing the adjustable length of the telescoping pair of tubes with the locking assembly including a generally cylindrical threaded sleeve fixed to the outer tube opposite its capped end, a locking cap seated upon the inner tube and threaded to mate adjustably with a locking sleeve, and a compression ring seal seated upon the inner tube and captured between the sleeve and the locking cap which upon tightening of the locking cap relative the threaded sleeve causes the ring seal to bind frictionally the two telescoping tubes to a fixed length; and a guy rope coupled to the mooring bar between the outer tube and the compression ring thereby isolating the lock from the guying force exerted by the guying rope.

9. The combination of claim 8 in which the guy rope is formed with a ring loop which envelops the inner tube, thereby enhancing the frictional force which locks the two telescoping tubes to a fixed length.

10. The combination of claim 8 in which the ring loop is lodged in an annular cavity defined by the locking sleeve and the outer tube.

11. The combination of claim 8 comprising an anchor eyebolt attached to the guy rope and in which the eyebolt is locked by the outer tube and the locking sleeve.

* * * * *